United States Patent [19]

Ozaki et al.

[11] Patent Number: 4,876,184

[45] Date of Patent: Oct. 24, 1989

[54] HEAT-DEVELOPABLE LIGHT-SENSITIVE MATERIAL

[75] Inventors: Hiroyuki Ozaki; Ken Kawata, both of Kanagawa, Japan

[73] Assignee: Fuji Photo Film Co., Ltd., Kanagawa, Japan

[21] Appl. No.: 165,059

[22] Filed: Mar. 7, 1988

[30] Foreign Application Priority Data

Mar. 6, 1987 [JP] Japan ..... 62-50373

[51] Int. Cl.[4] ..... G03C 1/34

[52] U.S. Cl. ..... 430/607; 430/617

[58] Field of Search ..... 430/617, 607, 613

[56] References Cited

U.S. PATENT DOCUMENTS

| | | | |
|---|---|---|---|
| 4,499,172 | 2/1985 | Hirai et al. | 430/619 |
| 4,626,500 | 12/1986 | Sato et al. | 430/619 |
| 4,629,684 | 12/1986 | Sato et al. | 430/619 |
| 4,657,848 | 4/1987 | Sato et al. | 430/617 |

*Primary Examiner*—Paul R. Michl
*Assistant Examiner*—Janet C. Baxter
*Attorney, Agent, or Firm*—Sughrue, Mion, Zinn, Macpeak & Seas

[57] ABSTRACT

A novel heat-developable light-sensitive material is provided comprising at least one light-sensitive silver halide emulsion layer provided on a support, and further containing an acetylene compound represented by the general formula (I):

$$R_1\text{-}(L\text{—}C{\equiv}C\text{—}R_2)_n \qquad (I)$$

wherein L represents a mere bond or a divalent connecting group; n represents an integer of 1 to 4; $R_1$ represents a hydrogen atom, a carboxyl group, or a substituted or unsubstituted alkyl group, cycloalkyl group, alkenyl group, alkynyl group, aralkyl group, aryl group, or heterocyclic group when n is 1, and represents a divalent, trivalent or tetravalent residual group when n is 2, 3 or 4; and $R_2$ represents a hydrogen atom, a carboxyl group, or a substituted or unsubstituted alkyl group, cycloalkyl group, alkenyl group, alkynyl group, aralkyl group, aryloxycarbonyl group, alkoxycarbonyl group, aryl group, heterocyclic group, or carbamoyl group, with the following two provisos: (1) when n is 2, 3 or 4, the plurality of —L—C≡C—$R_2$ may be the same or different, exclusive of the case where L is a mere bond, and (2) when n is 1, $R_1$ and $R_2$ cannot both represent a hydrogen atom at the same time.

7 Claims, No Drawings

HEAT-DEVELOPABLE LIGHT-SENSITIVE MATERIAL

FIELD OF THE INVENTION

The present invention relates to a heatdevelopable light-sensitive material. More particularly, the present invention relates to a heat-developable light-sensitive material which exhibits an excellent ability to stay fresh for long time and also maintains stable photographic properties against any fluctuation in development processing conditions.

BACKGROUND OF THE INVENTION

Because of its excellent photographic properties such as sensitivity and gradation adjustment (as compared to other photographic processes such as electrophotography and diazo process), the process using silver halide has heretofore been most widely used. In recent years, a new process has been developed by which images can be easily and rapidly obtained on a silver halide light-sensitive material. This was accomplished by using a heat development requiring no developing solution rather than the conventional wet process in which a developing solution is used at near normal temperature.

A heat-developable light-sensitive material is well known in the art. Examples of a heat-developable light-sensitive material and heat development process are described in *Shashinkogaku no Kiso* (Corona Co., Ltd., 1979), pp. 553–555, *Hakko Eizo Joho,* April, 1978, p. 40, *Nebletts Handbook of Photography and Reprography,* 7th Ed., Van Nostrand Reinhold Company, pp. 32 and 33, U.S. Pat. Nos. 3,142,904, 3,301,678, 3,392,020 and 3,457,075, British Pat. Nos. 1,131,108 and 1,167,777, and *Research Disclosure,* No. 17029, June, 1978, pp. 9 to 15.

Many processes have been proposed which use a heat development process to obtain color images. In connection with a process for the formation of color images by the combination of an oxidation product of a developing agent and a coupler, many compounds have been proposed. For example, a combination of a phenylenediamine reducing agent and a phenolic or active methylene coupler is described in U.S. Pat. No. 3,531,286. A p-aminophenol reducing agent is described in U.S. Pat. No. 3,761,270. Sulfonamidophenolic reducing agents are described in Belgian Pat. No. 802,519 and *Research Disclosure,* September, 1975, pp. 31 and 32. A combination of a sulfonamidophenolic reducing agent and a 4-equivalent coupler is described in U.S. Pat. No. 4,021,240.

In connection with a method for the formation of positive color images by a light-sensitive silver dye bleach process, many processes have been proposed. For example, examples of useful dyes and bleach processes are described in *Research Disclosure,* No. 14433, April, 1976, pp. 30 to 32, and 15227, December, 1976, pp. 14 and 15, and U.S. Pat. No. 4,235,957.

Furthermore, an image formation process involving a heat development process which utilizes a compound which has previously possessed a dye portion and is capable of releasing a mobile dye in response or counter response to the reduction reaction of silver halide to silver at an elevated temperature is disclosed in European Pat. Nos. 76,492A and 79,056A and Japanese Patent Application (OPI) Nos. 28928/83 and 26008/83 (the term "OPI" as used herein refers to a "published unexamined Japanese patent application").

Such a heat-developable light-sensitive material undergoes development upon heating. However, such a heat-developable light-sensitive material is disadvantageous because after the material is heated to the necessary temperature, it takes a great deal of time for the material to cool down. The lengthy cool-down period causes overdevelopment which may lead to an increase in fog. Such a heat-developable light-sensitive material is also disadvantageous for another reason. When a dye produced or released in a lightsensitive element is heat-transferred to an image-receiving element, the heating required for the transfer process causes overdevelopment which may lead to an increase in fog on the transfer images. Furthermore, it is difficult to heat uniformly the light-sensitive material to an elevated temperature. This heating is an uneven heating temperature which is undesirable. However, if the light-sensitive material is uniformly heated, uneven amounts of water or of an image formation accelerator (such as base) remain in the light-sensitive material. These difficulties may cause a non-uniform progress of development or dye transfer, resulting in an uneven image which lowers the picture quality.

SUMMARY OF THE INVENTION

It is, therefore, an object of the present invention to provide a heat-developable light-sensitive material which exhibits an excellent ability to stay fresh for a long time and can also inhibit fog upon overdevelopment.

The above and other objects of the present invention will become more apparent from the following detailed description and examples.

These objects of the present invention are accomplished with a heat-developable light-sensitive material comprising at least one light-sensitive silver halide emulsion layer provided on a support, characterized in that there is contained in at least one of constituent layers provided on the side at which said emulsion layer is present an acetylene compound represented by the general formula (I):

$$R_1\text{-}(\text{-}L\text{—}C\equiv C\text{—}R_2)_n \qquad (I)$$

wherein L represents a mere bond or a divalent connecting group; n represents an integer of 1 to 4; $R_1$ represents a hydrogen atom, a carboxyl group, or a substituted or unsubstituted alkyl group, cycloalkyl group, alkenyl group, alkynyl group, an aralkyl group, aryl group, or heterocyclic group when n is 1, and represents a divalent, trivalent or tetravalent residual group when n is 2, 3 or 4; and $R_2$ represents a hydrogen atom, a carboxyl group, or a substituted or unsubstituted alkyl group, cycloalkyl group, alkenyl group, alkynyl group, aralkyl group, aryloxycarbonyl group, alkoxycarbonyl group, aryl group, heterocyclic group, or carbamoyl group, with the proviso that when n is 2, 3 or 4, the plurality of —L—C≡C—$R_2$ may be the same or different, excluding the case where when L is a mere bond and n is 1, $R_1$ and $R_2$ each represents a hydrogen atom at the same time.

DETAILED DESCRIPTION OF THE INVENTION

The general formula (I) is further illustrated hereinafter.

The alkyl group represented by $R_1$ or $R_2$ may be a straight chain or branched group. Examples of such an alkyl group include a butyl group, an isobutyl group, a hexyl group, a heptyl group, an octyl group, a dodecyl group, and a pentadecyl group. Examples of substituents for the substituted alkyl group represented by $R_1$ or $R_2$ include an alkoxy group such as a methoxy group, an aryloxy group, an acyloxy group, a heterocyclic oxy group, a hydroxyl group, a carboxyl group or salts thereof, a formyl group, an acyl group, a substituted or unsubstituted carbamoyl group, an alkoxycarbonyl group, an aryloxycarbonyl group, a mercapto group, an alkylthio group, an arylthio group, a sulfino group or salts thereof, a sulfo group or salts thereof, an alkylsulfinyl group, an alkylsulfonyl group, an arylsulfonyl group, a substituted or unsubstituted sulfamoyl group, an alkoxysulfonyl group, an aryloxysulfonyl group, an acylamino group, a substituted or unsubstituted ureido group, an alkoxycarbonylamino group, an aryloxycarbonylamino group, a nitro group, a nitroso group, a cyano group, a halogen atom, an alkylsulfonylamino group, an arylsulfonylamino group, a substituted or unsubstituted sulfamoylamino group, a substituted or unsubstituted amino group, a cycloalkyl group, an alkenyl group, an aryl group, an aralkyl group, a heterocyclic group, and an alkynyl group such as an ethynyl group. Two or more of these substituents may be contained in the substituted alkyl group represented by $R_1$ or $R_2$.

Examples of the cycloalkyl group represented by $R_1$ or $R_2$ include a cyclopentyl group, a cyclohexyl group, and a decahydronaphthyl group. Examples of the alkenyl group represented by $R_1$ or $R_2$ include a propenyl group, an isopropenyl group, and a styryl group. Examples of the alkynyl group represented by $R_1$ or $R_2$ include an ethynyl group and a phenylethynyl group. Examples of the aralkyl group represented by $R_1$ or $R_2$ include a benzyl group and a phenethyl group. These groups may contain substituents as described with reference to the alkyl group represented by $R_1$ or $R_2$. These groups also may contain two or more substituents.

Examples of the aryl group represents by $R_1$ or $R_2$ include a phenyl group and a naphthyl group. Examples of substituents for the substituted aryl group represented by $R_1$ or $R_2$ include an alkyl group such as a methyl group and a dodecyl group, an alkenyl group, an aryl group, a cycloalkyl group, an aralkyl group, an alkynyl group, a cyano group, a nitro group, a nitroso group, a substituted or unsubstituted amino group, an acylamino group, an alkylsulfonylamino group, an arylsulfonylamino group, a substituted or unsubstituted sulfamoylamino group, a hydroxyl grop, an alkoxy group, an aryloxy group, an alkoxycarbonyl group, an aryloxycarbonyl group, a heterocyclic oxy group, an acyloxy group, a heterocyclic group (5- or 6-membered, preferably nitrogen-containing heterocyclic group), an alkoxysulfonyl group, an aryloxysulfonyl group, an alkylsulfinyl group, an arylsulfinyl group, an alkylthio group, an arylthio group, a mercapto group, a formyl group, an acyl group, an alkylsulfonyl group, an arylsulfonyl group, a carboxylic acid group or salts thereof, a sulfonic acid group or salts thereof, a sulfino group or salts thereof, a halogen atom such as fluorine, bromine, chlorine, and iodine, and a substituted or unsubstituted ureido group, carbamoyl group, and sulfamoyl group. These substituents may be further substituted. Two or more of these substituents may be contained in the substituted aryl group represented by $R_1$ ot $R_2$.

The heterocyclic group represented by $R_1$ or $R_2$ is preferably 5- or 6-membered. Examples of such a heterocyclic group include a furyl group, a thienyl group, a benzothienyl group, a pyridyl group, and a quinoline group. These heterocyclic groups may contain substituents as described with reference to the abovedescribed substituted aryl group.

Examples of the aryloxycarbonyl group represented by $R_2$ include a phenoxycarbonyl group. Examples of the alkoxycarbonyl group represented by $R_2$ include a methoxycarbonyl group and an ethoxycarbonyl group.

Examples of the carbamoyl group represented by $R_2$ include a carbamoyl group substituted by the above-described substituted or unsubstituted alkyl group, aryl group, and heterocyclic group besides $—CONH_2$.

When n represents an integer of 2, 3 or 4, $R_2$ represents a divalent, trivalent, and tetravalent residual group, respectively. Examples of such residual groups include groups obtained by removing one, two or three hydrogen atoms from the above-described monovalent group represented by $R_1$ or $R_2$. When n is 2, examples of the group represented by $R_2$ include —NH—.

L represents a mere bond or a divalent connecting group, preferably an $$-O-\overset{\overset{\displaystyle O}{\|}}{C}-\text{ group}$$

or a —CONH— group.

The subscript n is preferably 1 or 2.

Preferred among the above-described groups represented by the general formula (I) is a group wherein one of $R_1$ and $R_2$ is a hydrogen atom and the other is a group other than a hydrogen atom.

More preferred is a group wherein one of $R_1$ and $R_2$ is a hydrogen atom and the other is a substituted or unsubstituted phenyl group. Particularly preferred is a group represented by the general formula (II):

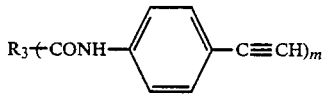

(II)

wherein m represents an integer of 1 or 2. When m is 1, $R_3$ represents a $C_{1-20}$-alkyl group, cycloalkyl group, alkenyl group, alkynyl group, aralkyl group, aryl group or heterocyclic group. When m is 2, $R_3$ represents an alkylene group, an arylene group, or a cycloalkylene group. These substituents may be substituted by other substituents.

$R_3$ will be further described hereinafter.

The alkyl group represented by $R_3$ may be a straight chain or branched group. Examples of such an alkyl group include a propyl group, an isopropyl group, a butyl group, an isobutyl group, a tertiary butyl group, a pentyl group, a hexyl group, a heptyl group, an isoheptyl group, an octyl group, a nonyl group, a decyl group, a dodecyl group, and a pentadecyl group. Examples of substituents for the substituted alkyl group represented by $R_3$ include a cycloalkyl group, an alkenyl group, an alkynyl group, an aryl group, an aralkyl group, a heterocyclic group, a halogen atom such as fluorine, chlorine, bromine and iodine, a hydroxyl group, an alkoxy group, an aryloxy group, an acyloxy group, a heterocyclic oxy group, a carboxyl group or salts thereof, a formyl group, an acyl group, a substituted or unsubstituted carbamoyl group, an alkoxycarbonyl group, an aryloxycarbonyl group, a cyano group, a mercapto group, an alkylthio group, an arylthio group, a sulfino group or salts thereof, a sulfo group or salts thereof, an alkylsulfinyl group, an arylsulfinyl group, an alkylsulfony group, an arylsulfonyl group, a substituted or unsubstituted sulfamoyl group, an alkoxysulfonyl group, an aryloxysulfonyl group, a substituted or unsubstituted amino group, an acylamino group, a substituted or unsubstituted ureido group, an alkoxycarbonylamino group, an aryloxycarbonylamino group, an alkylsulfonylamino group, an arylsulfonylamino group, and a substituted or unsubstituted sulfamoylamino group, a nitro group, and a nitroso group. Two or more of these groups may be contained in the substituted alkyl group. These substituents may be further substituted.

Examples of the cycloalkyl group represented by $R_3$ include a cyclopentyl group, a cyclohexyl group, and a decahydronaphthyl group. The alkenyl group represented by $R_3$ includes a propenyl group, an isopropenyl group, and a styryl group. The alkynyl group represented by $R_3$ includes an ethynyl group and a phenylethynyl group. These groups may contain substituents as described as to the alkyl group represented by $R_3$. Two or more of these substituents may be contained in these groups represented by $R_3$.

Examples of the aryl group represented by $R_3$ include a phenyl group and a naphthyl group. Examples of substituents for the substituted aryl group represented by $R_3$ include an alkyl group, a cycloalkyl group, an alkenyl group, an alkynyl group, an aryl group, an aralkyl group, a heterocyclic group (5-membered or 6-membered ring, preferably containing nitrogen atoms), a halogen atom such as fluorine, chlorine, bromine and iodine, a hydroxyl group, an alkoxy group, an aryloxy grop, an acyloxy group, a heterocyclic oxy group, a carboxyl group or salts thereof, a formyl group, an acyl group, a substituted or unsubstituted carbamoyl group, an alkoxycarbonyl group, an aryloxycarbonyl group, a cyano group, a mercapto group, an alkylthio group, an arylthio group, a sulfino group or salts thereof, a sulfo group or salts thereof, an alkylsulfinyl group, an arylsulfinyl group, an alkylsulfonyl group, an arylsulfonyl group, a substituted or unsubstituted sulfamoyl group, an alkoxysulfonyl group, an aryloxysulfonyl group, a substituted or unsubstituted amino group, an acylamino group, a substituted or unsubstituted ureido group, an alkoxycarbonylamino group, an aryloxycarbonylamino group, an alkylsulfonylamino group, an arylsulfonylamino group, and a substituted or unsubstituted sulfamoylamino group, a nitro group, and a nitroso group. These substituents may be further substituted. Two or more of the above-described substituents may be contained in the substituted aryl group represented by $R_3$.

Examples of the aralkyl group represented by $R_3$ include a benzyl group and a phenethyl group. These substituents may contain one or more substituents as described with reference to the alkyl group or aryl grop represented by $R_3$. Such substituents may be further substituted.

The heterocyclic group represented by $R_3$ is preferably 5- or 6-membered. Examples of such heterocyclic groups include a furyl group, a thienyl group, a benzothienyl group, a pyridyl group, and a quinoline group. These heterocyclic groups may contain substituents as described with reference to the abovedescribed substituted aryl group.

Examples of the alkylene group represented by $R_3$ include a methylene group, an ethylene group, a trimethylene group, and a propylene group. Examples of the arylene group represented by $R_3$ include an o-phenylene group, an m-phenylene group, a p-phenylene group, and a 1,4-naphthylene group. Examples of the cycloalkylene group represented by $R_3$ include a cyclohexylene group. The above-described divalent residual groups may contain one or more substituents as described with reference to the alkyl group or aryl group represented by $R_3$. Such substituents may be further substituted.

Preferred among those groups represented by $R_3$ is an alkyl group or cycloalkyl group containing 3 or more carbon atoms.

More preferred is an alkyl or cycloalkyl group containing 3 to 10 carbon atoms.

Specific examples of the present compound are shown hereinafter, but the present invention should not be construed as being limited thereto.

(1)

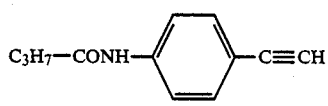

(2)

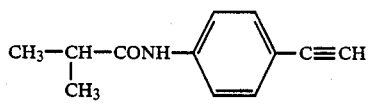

(3)

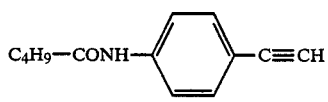

(4)

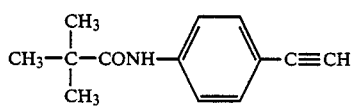

(5)

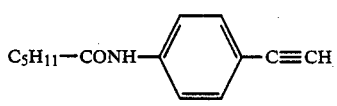

(6)

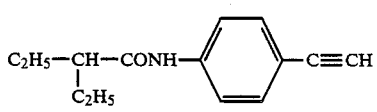

(7)

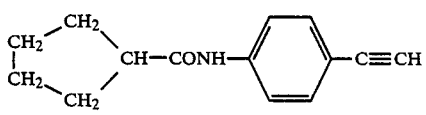

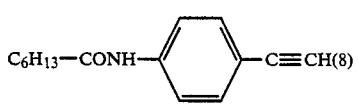

(9)

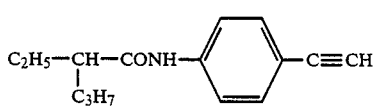

(10)

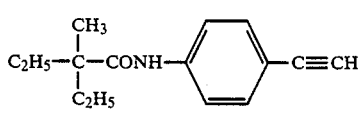

-continued (11)

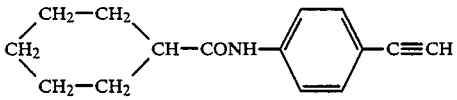

(12)

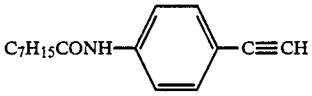

(13)

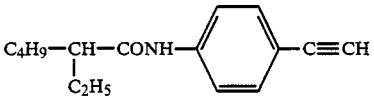

(14)

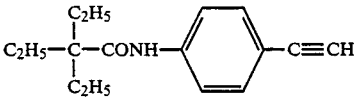

(15)

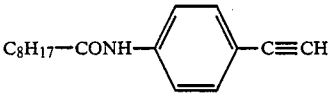

(16)

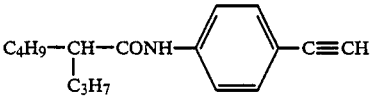

(17)

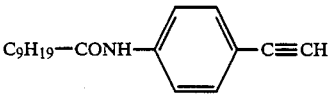

(18)

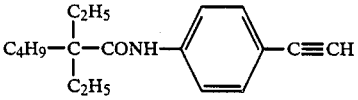

(19)

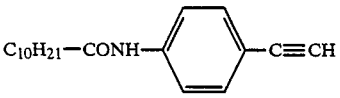

(20)

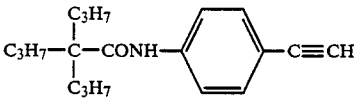

(21)

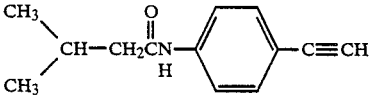

(22)

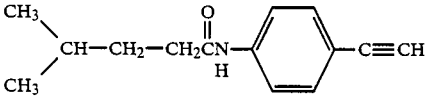

(23)

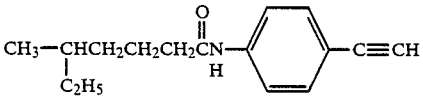

-continued (24)

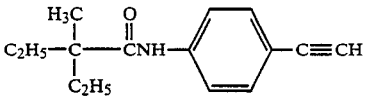

The acetylene compound of the present invention can be easily obtained by the condensation reaction of 4-ethynylaniline with the acid chloride of a carboxylic acid as shown below.

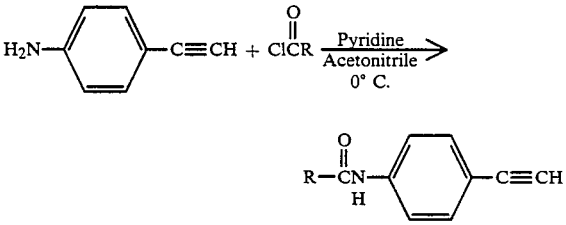

4-Ethynylaniline can be synthesized by a method as described in *Helvetica Chimica Acta,* Vol. 54, page 2066, 1971.

The acetylene compound to be used in the present invention may be incorporated in a binder in a light-sensitive layer and/or other constituent layers such as an intermediate layer and a protective layer, in the form of a solution in a water-soluble organic solvent such as methanol, ethanol, acetone, and dimethylformamide or a mixture of such an organic solvent with water.

For a structure in which a light-sensitive element and a dye fixing element are provided on the same support, the acetylene compound may be incorporated in any of these layers.

Furthermore, the acetylene compound to be used in the present invention may be incorporated in a binder in a light-sensitive element or dye fixing element in the form of a solution in a high boiling organic solvent optionally mixed with a low boiling organic solvent having a boiling point of 50° to 160° C. Alternatively, the acetylene compound to be used in the present invention may be incorporated in a binder in the form of a fine dispersion.

The amount of the acetylene compound to be incorporated is $10^{-4}$ to 1 mol, preferably $10^{-3}$ to $5\times10^{-1}$ mol, per mol of silver.

In the present invention, various known fog inhibitors or photographic stabilizers may be used in combination. Examples of such fog inhibitors or photographic stabilizers include azoles and azaindenes (as described in *Research Disclosure,* December, 1978, pp. 24 and 25), carboxylic acids or phosphoric acids containing nitrogen (as described in Japanese Patent Application (OPI) No. 168442/84) and mercapto compounds and salts thereof (as described in Japanese Patent Application (OPI) No. 111636/84).

The heat-developable light-sensitive material to be used in the present invention comprises at least a light-sensitive silver halide and a binder, and optionally an organic silver salt, a dye providing substance, and a reducing agent on a support.

The silver halide which can be used in the present invention may be any one of silver chloride, silver bromide, silver bromochloride, silver chloroiodide, and silver chlorobromoiodide.

Particularly, any silver halide emulsions as described in U.S. Pat. No. 4,500,626 (50th column), *Research Disclosure,* No. 17029, June, 1978, pp. 9 and 10, Japanese Patent Application (OPI) Nos. 107240/86, 85241/87, and 87957/87 may be used.

The silver halide emulsion to be used in the present invention may be of surface latent image type in which latent images are formed mainly in the surface portion of particles or internal latent image type in which latent images are formed mainly in the interior of particles. The silver halide emulsion to be used in the present invention may be a so-called core/shell emulsion in which the surface differs from the interior thereof in phase. In the present invention, a direct reversal emulsion comprising a combination of an internal latent image type emulsion and a nucleating agent may be used.

The present silver halide emulsion may be used unripened. However, it is normally chemically sensitized before use. Emulsions for ordinary light-sensitive material may be subjected to known sulfur sensitization processes, reduction sensitization processes, and noble metal sensitization processes, singly or in combination. These chemical sensitization processes may be effected in the presence of a nitrogen-containing heterocyclic compound as described in Japanese Patent Application (OPI) Nos. 126526/83 and 215644/83.

In the present invention, the amount of light-sensitive silver halide to be coated is in the range of 1 mg/m$^2$ to 10 g/m$^2$ in terms of silver.

In the present invention, the light-sensitive silver halide may be used in combination with an organic metal salt as an oxidizing agent. In this case, it is necessary that the light-sensitive silver halide and the organic metal salt be kept in contact with or close to each other.

Particularly preferred among such organic metal salts are organic silver salts.

Examples of organic compounds which can be used to form the above-described silver salt oxidizing agent include compounds described in Japanese Patent Application (OPI) No. 107240/86 (pp. 37 to 39), and U.S. Pat. No. 4,500,626 (52nd column to 53rd column). Other useful examples of such organic compounds include silver salts of carboxylic acids containing an alkynyl group such as silver phenylpropiolate as described in Japanese Patent Application (OPI) No. 113235/85, and acetylene silver as described in Japanese Patent Application (OPI) No. 249044/86. Two or more organic silver salts may be used in combination.

These organic silver salts may be used in an amount of 0.01 to 10 mols, preferably 0.01 to 1 mols, per mol of light-sensitive silver halide. The total amount of light-sensitive silver halide and organic silver salt to be coated is preferably in the range of 50 mg to 10 g/m$^2$ in terms of silver.

The silver halide to be used in the present invention may be spectrally sensitized by a methine dye or the like. Examples of such a dye include cyanine dyes, merocyanine dyes, complex cyanine dyes, complex merocyanine dyes, holopolar cyanine dyes, hemicyanine dyes, styryl dyes and hemioxonol dyes.

Specific examples of such dyes include sensitizing dyes as described in Japanese Patent Application (OPI) Nos. 180550/84 and 140335/85, and *Research Disclosure,* No. 17029, June, 1978, pp. 12 and 13, and heat-decolorable sensitizing dyes as described in Japanese Patent Application (OPI) Nos. 111239/85 and 32446/87.

These sensitizing dyes may be used singly or in combination. Such a combination of sensitizing dyes is often used particularly for the purpose of supersensitization.

Besides such a sensitizing dye, the present emulsion may contain a dye which has no spectral sensitizing effect itself or a substance which does not substantially absorb visible light but exhibits supersensitizing effect as described in U.S. Pat. Nos. 2,933,390, 3,635,721, 3,743,510, 3,615,613, 3,615,641, 3,617,295 and 3,635,721.

These sensitizing dyes may be added to the emulsion during, before or after chemical ripening. Alternatively, it may be before or after the formation of nucleus of particulate silver halide in accordance with U.S. Pat. Nos. 4,183,756 and 4,225,666.

The added amount of such a sensitizing dye is normally in the range of $10^{-8}$ to $10^{-2}$ mol per mol of silver halide.

In the present invention, images may be formed of silver or of a dye providing substance as described later.

Such a dye providing substance is further described hereinafter.

As a suitable dye providing substance for the present invention there may be used a coupler capable of reacting with a developing agent. In this process, the developing agent undergoes a reduction oxidation with a silver salt to form an oxidation product of the developing agent which will then react with the coupler to form a dye. Such a process is described in many literatures. Such a coupler may be 2- or 4-equivalent. A 2-equivalent coupler which contains a nondiffusible group in split-off group and undergoes reaction with an oxidation product of a developing agent to form a diffusible dye may be preferably used. Specific examples of such a developing agent and coupler are described in detail in T. H. James, *The Theory of the Photographic Process,* pp. 291 to 334 and pp. 354 to 361, and Japanese Patent Application (OPI) Nos. 123533/83, 149046/83, 149047/83, 111148/84, 124399/84, 174835/84, 231539/84, 231540/84, 2950/85, 2951/85, 14242/85, 23474/85 and 66249/85.

A dye-silver compound comprising a combination of organic silver salt and dye may be used as a dye providing substance. Specific examples of such a dye-silver compound are described in *Research Disclosure,* No. 16966, May, 1978, pp. 54 to 58.

Furthermore, an azo dye for use in heatdevelopable silver dye bleach process may be used as a dye providing substance. Specific examples of such an azo dye and bleach process are described in U.S. Pat. No. 4,235,957, and *Research Disclosure,* No. 14433, April, 1976, pp. 30 to 32. Moreover, leuco dyes as described in U.S. Pat. Nos. 3,985,565 and 4,022,617 may be used as dye providing substances.

Other examples of such a dye providing substance include a compound which serves to release or diffuse a diffusible dye imagewise. This type of a compound can be represented by the following general formula (LI):

$$(\text{Dye}—\text{X})_n—\text{Y} \qquad \text{(LI)}$$

wherein Dye represents a dye group, which dye group has been temporarily shifted to shorter wavelength range or dye precursor; X represents a mere bond or connecting bond; Y represents a group which differentiates the diffusibility of the compound represented by $(\text{Dye}—\text{X})_n—\text{Y}$ in response or counter-response to light-sensitive silver salt having an imagewise latent image or group which releases Dye and differentiates between Dye thus released and $(Dye—X)_n—Y$ in diffusibility; and n represents an integer of 1 or 2, with the proviso that when n is 2, the two (Dye-X) may be the same or different.

Specific examples of the dye providing substance represented by the general formula (LI) include a dye developer in which a hydroquinone developer and a dye component are connected to each other as described in U.S. Pat. Nos. 3,134,764, 3,362,819, 3,597,200, 3,544,545 and 3,482,972. Other examples of such a dye providing substance include a substance which undergoes an intramolecular nucleophilic displacement reaction to release a diffusible dye as described in Japanese Patent Application (OPI) No. 63618/76, and a substance which undergoes an intramolecular rewind reaction of isooxazolone to release a diffusible dye as described in Japanese Patent Application (OPI) No. 111628/74. In these processes, a diffusible dye is released or diffused at portions where no development took place while no dye is released or diffused at portions where development took place.

Another process has been proposed. In this process, a dye releasing compound is converted to an oxidation product incapable of releasing a dye. The oxidation product of a dye releasing compound is present with a reducing agent or precursor thereof. After development, the oxidation product is reduced by a reducing agent which has remained unoxidized to release a diffusible dye. Specific examples of such a dye providing substance which may be used in this process are described in Japanese Patent Application (OPI) Nos. 110827/78, 130927/79, 164342/81 and 35533/78.

Other examples of compounds which employ the similar mechanism to release a diffusible dye include compound groups as described in U.S. Application Ser. No. 925,350, filed October 30, 1986. These compounds undergo an N-O cleavage by a remaining reducing agent to provide a diffusible dye.

On the other hand, examples of a substance which releases a diffusible dye at portions where development took place include a diffusible dye which undergoes a reaction of a coupler containing a diffusible dye in split-off group with an oxidation product of a developing agent as described in British Pat. No. 1,330,524, Japanese Patent Publication No. 39165/73, and U.S. Pat. No. 3,443,940.

In these processes using a color developing agent, stain of images by an oxidation decomposition product of a developing agent becomes a serious problem. To overcome such a problem, a dye releasing compound has been proposed which needs no developing agent but has a reducing power itself. Typical examples of such a dye releasing compound include dye donating substances as described in U.S. Pat. Nos. 3,928,312, 4,053,312, 4,055,428, 4,336,322, 3,725,062, 3,728,113, 3,443,939 and 4,500,626, Japanese Patent Application (OPI) Nos. 65839/84, 69839/84, 3819/78, 104343/76, 116537/83 and 179840/82, and *Research Disclosure,* No. 17465.

Specific examples of dye providing substance which can be used in the present invention include compounds as described in U.S. Pat. No. 4,500,626 (22nd column to 44th column). Particularly preferred among these compounds are Compounds (1) to (3), (10) to (13), (16) to (19), (28) to (30), (33) to (35), (38) to (40), and (42) to (64) described in the above cited U.S. Patent. Other useful examples of dye providing substances are compounds as described in Japanese Patent Application (OPI) No. 124941/86.

The above-described dye donating compounds and hydrophobic additives such as image formation accelerator as described later may be incorporated in layers in the light-sensitive material by any suitable method as described in U.S. Pat. No. 2,322,027. In this case, a high boiling organic solvent as described in Japanese Patent Application (OPI) Nos. 83154/84, 178451/84, 178452/84, 178453/84, 178454/84, 178455/84 and 178457/84 may be used optionally in combination with a low boiling organic solvent having a boiling point of 50° to 160° C.

The amount of such a high boiling organic solvent to be used is normally 10 g or less, preferably 5 g or less, per g of dye providing substance.

A dispersion process using a polymer as described in Japanese Patent Publication No. 39853/76 or Japanese Patent Application (OPI) No. 59943/76 may be used.

If the additive is a compound which is substantially water-insoluble, it may be incorporated in the binder in the form of a fine dispersion instead of using the above-mentioned methods.

When a hydrophobic substance is dispersed in a hydrophilic colloid, various surface actiev agents can be used. Examples of such surface actiev agents which can be used in this process include those described as surface active agents in Japanese Patent Application (OPI) No. 157636/84 (pp. 37 and 38).

In the present invention, a reducing agent may be preferably incorporated in the light-sensitive material. As such reducing agents there may be used the above-described dye providing substances having a reducing power besides compounds commonly known as reducing agents. Furthermore, as such a reducing agent there can be used a reducer precursor which has no reducing power itself but takes on reducing power when acted on by a nucleophilic reagent or heat during development.

Examples of reducing agents which can be used in the present invention include reducing gents as describd in U.S. Pat. No. 4,500,626 (49th column to 50th column) and 4,483,914 (30th column to 31st column), and Japanese Patent Application (OPI) Nos. 140335/85 (pp. 17 and 18), 128438/85, 128436/85, 128439/85 and 128437/85. Other examples of compounds which can be used as reducing agents include reducer precursors as described in Japanese Patent Application (OPI) Nos. 138736/81 and 40245/82, and U.S. Pat. No. 4,330,617.

Combinations of various developing agents as disclosed in U.S. Pat. No. 3,039,869 may be used in the present invention.

In the present invention, the added amount of such a reducing agent is preferably 0.01 to 20 mols, particularly 0.1 to 10 mols, per mol of silver.

The present light-sensitive material may comprise an image formation accelerator. Such an image formation accelerator serves to accelerate oxidation reaction of a silver salt oxidizing agent with a reducing agent, reaction such as formation or decomposition of a dye or release of a diffusible dye from a dye providing substance, and migration of a dye from a light-sensitive material layer to a dye fixing layer. In the light of physicochemical function, image formation accelerators can be classified into base or base precursor, nucleophilic compound, high boiling organic solvent (oil), heat solvent, surface active agent, compound capable of interacting with silver or silver ion, etc. However, these substance groups generally have a composite function and thus a combination of the above-described accelerating effects. The details are described in Japanese Patent Application (OPI) No. 93451/86.

Besides the above-described image formation accelerator, there are various methods for the generation of a base. Any compounds which can be used in such methods are useful as base precursors. Examples of such methods include a method described in Japanese Patent Application (OPI) Nos. 129848/87 and 187847/87 which comprises mixing a sparingly soluble metal compound with a compound capable of complexing with metal ions constituting the sparingly soluble metal compound (i.e., complexing compoudn) to generate a base, and a method described in Japanese Patent Application (OPI) No. 232451/86 which comprises electrolysis to generate a base.

The former method is particularly effective. Examples of such a sparingly soluble metal compound include carbonate, hydroxide, and oxide of zinc, aluminum, calcium, and barium. The above-described complexing compound is described in detail in A. E. Martell, R. M. Smith, *Critical Stability Constants,* Vol. 4 and Vol. 5, Plenum Press. Specific examples of such a complexing compound include salts of aminocarboxylic acids, imidinoacetic acids, pyridylcarboxylic acids, aminophosphoric acids, carboxylic acids such as mono-, di-, tri- and tetracarboxylic acids, and compounds containing substituents such as a phosphono group, a hydroxyl group, an oxo group, an ester group, an amido group, an alkoxy group, a mercapto group, an alkylthio group, and a phosphino group, hydroxamic acids, polyacrylates, and polyphosphoric acids with alkali metals, guanidines, amidines, and quaternary ammonium salts.

Advantageously, the sparingly soluble metal compound and the complexing compound may be separately added to the light-sensitive material. When the light-sensitive material is a diffusion transfer type light-sensitive material, these additives may be advantageously added separately to the light-sensitive material and the dye fixing material.

Alternatively, one of the two additives may be added to the light-sensitiev material and the other may be supplied in the form of a solution in a liquid.

In the present invention, various development stop agents can be used for the purpose of providing a constant image against any fluctuation in processing temperature and time during development.

The term "development stop agent" as used herein means (1) a compound which rapidly neutralizes or reacts with a base to decrease the base concentration in the film so that development is stopped after proper development or (2) a compound which interacts with silver or silver salt to inhibit development after proper development. Specific examples of such a development stop agent include an acid precursor which releases an acid upon heating, electrophilic compound which undergoes a displacement reaction with a base present therewith upon heating, and nitrogen-containing heterocyclic compound, mercapto compound and precursors thereof as described in U.S. Application Ser. No. 672,643 (Nov. 19, '84), 711,885 (Mar. 14, '85), 727,718 (Apr. 26, '85), and 727,978 (Apr. 26, '85).

Furthermore, a compound which releases a mercapto compound upon heating may be useful in the present invention. Examples of such a compound include those described in Japanese Patent Application (OPI) Nos. 67851/86, 147244/86, 124941/86, 185743/86, 182039/86, 185744/86, 184539/86, 188540/86 and 53632/86.

In the present invention, the light-sensitive material may comprise a compound which serves to activate images as well as to stabilize images. Specific examples of such a compound which can be preferably used in the present invention are described in U.S. Pat. No. 4,500,626 (51st column to 52nd column).

In the present invention, various fog inhibitors can be used. Examples of such fog inhibitors which can be used in the present invention include azoles, carboxylic acids and phosphoric acids containing nitrogen atoms as described in Japanese Patent Application (OPI) No. 168442/84, mercapto compounds and metallic salts thereof as described in Japanese Patent Application (OPI) No. 111636/84, and acetylene compounds as described in Japanese Patent Application (OPI) No. 87957/87.

In the present invention, the light-sensitive material may optionally comprise an image toner. Specific examples of such an image toner which can be effectively used in the present invention include compounds as described in Japanese Patent Application (OPI) No. 147244/86.

Binders for the present light-sensitive material and a dye fixing material which can be optionally used may be used singly or in combination. Hydrophilic binders may be used as such binders. Typically, transparent or semi-transparent hydrophilic binders may also be used as such hydrophilic binders. Examples of such binders include natraul substances such as proteins (e.g., gelatin and gelatin derivatives), cellulose derivatives, and polysaccharides such as starch and gum arabic, and synthetic polymerized substances such as water-soluble polyvinyl compound (e.g., polyvinyl pyrrolidone and acrylamide polymer). Other examples of such a synthetic polymerized substance include a dispersed vinyl compound which may be used in the form of a latex to increase the dimensional stability of photographic materials.

In the present invention, the amount of the binder to be coated is 20 g or less, preferably 10 g or less, particularly 7 g or less, per square meter.

The amount of the high boiling organic solvent to be dispersed in the binder together with a hydrophobic compound such as dye providing substance is 1 cc or less, preferably 0.5 cc or less, particularly 0.3 cc or less, per g of binder.

The present photographic light-sensitive material and dye fixing material may contain an inorganic or organic film hardener in the photographic emulsion layer or other binder layers.

Specific examples of such a film hardener include those described in Japnese Patent Application (OPI) Nos. 147244/86 and 157636/84. These film hardeners may be used singly or in combination.

The supports used for both the present light-sensitive material and any dye fixing material which may be optionally used must withstand the desired processing temperature. Typically, glass, paper, cast coated paper, synthetic paper, polymer film, metal, and analogous materials can be used as supports. Other examples of supports which can be used in the present invention include those described as supports in Japanese Patent Application (OPI) No. 147244/8.

If the light-sensitive material of the present invention contains a dye providing substance, it is not so necessary that the light-sensitive material further contains an anti-irradiation substance or various dyes. In this case, the lightsensitive material may contain a filter dye or absorbing substance as described in literatures cited in Japanese Patent Application (OPI) No. 147244/86 and U.S. Pat. No. 4,500,626 (55th column, lines 41 to 52).

The light-sensitive material to be used in the present invention may optionally comprise various additives known as heat-developable light-sensitive material, or layers other than light-sensitiev layer, such as an antistatic layer, an electrically conductive layer, a protective layer, an intermediate layer, an AH layer, a peel-apart layer, and a mat layer. Examples of such various additives include those described in *Research Disclosure,* No. 17029, June, 1978, pp. 9 to 15, and Japanese Patent Application (OPI) No. 88256/86, such as a plasticizer, a dye for improving sharpness, an AH dye, a sensitizing dye, a mat agent, a surface active agent, a fluorescent brightening agent, an ultraviolet absorber, an antislip agent, an oxidation inhibitor, and a discoloration inhibitor.

In particular the protective layer normally comprises an organic or inorganic mat agent in order to inhibit adhesion. The protective layer also may contain a mordant or ultraviolet absorber. The protective layer and intermediate layer may be composed of two or more layers.

Furthermore, the intermediate layer may contain a reducing agent for inhibiting discoloration, ultraviolet absorber, or white pigment such as $TiO_2$. Such a white pigment may also be contained in the emulsion layer for the purpose of improving the sensitivity.

The present photographic element is composed of a light-sensitive element which forms or releases a dye upon heat development, and optionally a dye fixing element which serves to fix a dye.

Particularly in a system which employs a dye diffusion transfer to form images, a light-sensitive element and a dye fixing element are essential. Typical embodiments of such a system are roughly divided into two systems: an embodiment in which a light-sensitive element and a dye fixing element are separately coated on two supports and an embodiment in which a light-sensitive element and a dye fixing element are coated on the same support.

For the relationship between the dye element and the dye fixing element, between the dye element and the support, and between the dye element and the white reflecting layer, those described in Japanese Patent Application (OPI) No. 147244/86 and U.S. Pat. No. 4,500,626 (57th column) can be applied to the present invention.

A typical embodiment of the system in which a light-sensitive element and a dye fixing element are coated on the same support is a system in which a light-sensitive element is not needed to be peeled off a dye fixing element after the formation of a transfer image. In this case, a light-sensitive element, a dye fixing element and a white reflecting layer are accumulated on a transparent or opaque support.

Another typical embodiment of the system in which a light-sensitive element and a dye fixing element are coated on the same support is a system in which the light-sensitive element is partially or entirely peeled off the dye fixing element as described in Japanese Patent Application (OPI) No. 67840/81, Canadian Pat. No. 674,082, and U.S. Pat. No. 3,730,718. In this system, a peel-apart layer is coated on a proper position.

The light-sensitive element or dye fixing element may contain an electrically conductive heating element layer as a heating means for heat development or dye diffusion transfer.

In such an embodiment, a transparent or opaque heating element may be prepared as a resistance heating element using a known technique.

Such a resistance heating element may be prepared from a hard film of an inorganic material having semiconductivity or from a hard film of an organic material having electrically conductive particles dispersed in a binder. As such materials there can be used those described in U.S. Application Ser. No. 757,556 (Jul. 22, 1985).

The dye fixing element which may be optionally used in the present invention comprises at least one layer containing a mordant. If the dye fixing layer is provided on the surface of the light-sensitive material, a protective layer may be further provided as necessary.

For the layer structure of the dye fixing element, and the position of the binder, additive and mordant layers, those described in Japanese Patent Application (OPI) No. 147244/86 and patents cited therein can be applied to the present invention.

The dye fixing element to be used in the present invention may optionally comprise a peel-apart layer, a mat agent layer and an anticurl layer besides the above-described layers.

One of or a plurality of the above-described layers may contain a base and/or base precursor for accelerating dye transfer, a hydrophilic heat solvent, a discoloration inhibitor for inhibiting discoloration of a dye, an ultraviolet absorber, a lubricant, a mat agent, an antioxidant, a dispersed vinyl compound for improving dimensional stability, a fluorescent brightening agent, or the like. Specific examples of such additives are described in Japanese Patent Application (OPI) No. 88256/86.

The binder to be used in the above-described layers is preferably hydrophilic. As such a hydrophilic binder there is typically used a transparent or semitransparent hydrophilic colloid. Specifically, there can be used binders as described with reference to the above-described light-sensitive material.

As an image receiving layer of the present invention there can be used a dye fixing layer for use in a heat-developable color light-sensitive material. Such a dye fixing layer can be arbitrarily selected from commonly used mordants. Particularly preferred among these mordants is a polymer mordant. The term "polymer mordant" as used herein means a polymer containing a tertiary amino group, a polymer containing a nitrogen-containing heterocyclic portion, or a polymer containing a quaternary cation group thereof.

Specific examples of such a polymer mordant are described in Japanese Patent Application (OPI) No. 147244/86 and U.S. Pat. No. 4,500,626 (pp. 57 to 60).

With respect to the process for the coating of a heat-developable light-sensitive layer, a protective layer, an intermediate layer, a subbing layer, a backing layer, etc., those described in U.S. Pat. No. 4,500,626 (55th column to 56th column) can be applied to the present invention.

As a light source to be used in the imagewise exposure for recording of images on a heat-developable light-sensitive material there can be used radiation including visible light. For example, light sources as described in Japanese Patent Application (OPI) No. 147244/86 and U.S. Pat. No. 4,500,626 (56th column) can be used in the present invention.

The heating temperature required for development at the heat development is in the range of about 50° C. to about 250° C., particularly about 80° C. to about 180° C. The heating temperature required for transfer of a dye at the transfer process is preferably in the range of room temperature to the same upper limit as that of the heat development, particularly in the range of 50° C. to about 10° C. lower than the abovedescribed upper limit. As a heating means for the development process and/or transfer process there can be used heating plate, iron, heat roller, or heating element comprising carbon or titanium white.

Japanese Patent Application (OPI) Nos. 218443/84 and 238056/86 describe a particularly useful process in which a light-sensitive material is heated in the presence of a small amount of solvent such as water so that development and transfer are simultaneously or sequentially effected. In such a process, the above-described image formation accelerator may be previously incorporated in either or both of the dye fixing material and the light-sensitiev material or may be externally supplied.

In the above-described system in which development and transfer are simultaneously or sequentially effected, the heating temperature is preferably in the range of 50° C. to not higher than the boiling point of the solvent used. For example, if the solvent is water, the suitable heating temperature is in the range of 50° C. to 100° C.

Any suitable solvent may be for the transfer of a mobile dye to the dye fixing layer.

Examples of such a solvent which can be used to accelerate development and/or migration of a mobile dye to the dye fixing layer include water, and a basic aqueous solution containing an inorganic alkali metal salt or organic base as described with reference to the image formation accelerator. There can also be used a low boiling solvent, or a mixture of a low boiling solvent and water or a basic aqueous solution. Alternatively, a surface active agent, a fog inhibitor, a sparingly soluble metallic salt, a complexing compound, or the like may be contained in the solvent. Particularly preferred among these solvents is water.

These solvents may be imparted to either or both of the dye fixing material and the light-sensitive material. The amount of the solvent to be used may be as small as less than the weight of the solvent of a volume equivalent to the maximum wet volume of the entire coated film (particularly, not more than the value obtained by subtracting the weight of the entire coated film from the weight of the solvent of a volume equivalent to the maximum wet volume of the entire coated film).

Such a solvent as water may be imparted between the light-sensitive layer in the heat-developable light-sensitive material and the dye fixing layer in the dye fixing material to accelerate the formation of images and/or migration of a dye. Alternatively, the solvent may be previously incorporated in either the light-sensitive layer or the dye fixing material or both of them.

With respect to the process for imparting the solvent to the light-sensitive layer or the dye fixing layer, those described in Japanese Patent Application (OPI) No. 147244/86 can be applied to the present invention.

Alternatively, a system may be used in which a hydrophilic heat solvent which stays solid at normal temperature but melts at an elevated temperature is incorporated in a light-sensitive material or dye fixing material. Such a hydrophilic heat solvent may be incorporated in either or both of the light-sensitive material and the dye fixing material. The layer in which the hydrophilic heat solvent is to be incorporated is any one of emulsion layer, intermediate layer, protective layer, and dye fixing layer, particularly dye fixing layer and/or adjacent layers.

Examples of such a hydrophilic heat solvent include ureas, pyridines, amides, sulfonamides, imides, alcohols, oximes, and other heterocyclic compounds.

Examples of heating means to be used in the transfer process include those described in Japanese Patent Application (OPI) No. 147244/86. Alternatively, a layer of an electrically conductive material such as graphite, carbon black, and metal may be superimposed on the dye fixing layer so that the dye fixing layer can be directly heated when an electric current is passed through the electrically conductiev layer.

The pressure condition and pressure application process to be used when the heat-developable light-sensitive material and the dye fixing material are brought into close contact with each other are described in detail in Japanese Patent Application (OPI) No. 147244/86.

The present invention will be further illustrated in the following examples, but the present invention should not be construed as being limited thereto. Unless otherwise indicated herein, all parts, percents, ratios and the like are by weight.

EXAMPLE 1

The process for the preparation of silver halide emulsions for the 5th layer and the 1st layer is described hereinafter.

600 ml of an aqueous solution containing sodium chloride and potassium bromide and an aqueous solution of silver nitrate which had been prepared by dissolving 0.59 mol of silver nitrate in 600 ml of water were simultaneously added to an aqueous solution of gelatin which had been prepared by dissolving 20 g of gelatin and 3 g of sodium chloride in 1,000 ml of water and kept at a temperature of 75° C. at the same flow rate in 40 minutes while the latter was being vigorously stirred. Thus, a monodispersed emulsion of cubic particulate silver bromochloride (bromine content: 50 mol %) having an average particle size of 0.40 μm was prepared.

After being washed with water and desalted, the emulsion was chemically sensitized with 5 mg of sodium thiosulfate and 20 mg of 4-hydroxy-6-methyl-1,3,3a,7-tetraazaindene at a temperature of 60° C. The yield of the emulsion was 600 g.

The process for the preparation of a silver halide emulsion for the 3rd layer is described hereinafter.

600 ml of an aqueous solution containing sodium chloride and potassium bromide and an aqueous solution of silver nitrate which had been prepared by dissolving 0.59 mol of silver nitrate in 600 ml of water were simultaneously added to an aqueous solution of gelatin which had been prepared by dissolving 20 g of gelatin and 3 g of sodium chloride in 1,000 ml of water and kept at a temperature of 75° C. at the same flow rate in 40 minutes while the latter was being stirred vigorously. Thus, a monodispersed emulsion of cubic silver bromochloride (bromine content: 80 mol %) having an aevrage particle size of 0.35 μm was prepared.

After being washed with water and desalted, the emulsion was chemically sensitized with 5 mg of sodium thiosulfate and 20 mg of 4-hydroxy-6-methyl-1,3,3a,7-tetraazaindene at a temperature of 60° C. The yield of the desired emulsion was 600 g.

The process for the preparation of a benzotriazole silver emulsion is described hereinafter.

28 g of gelatin and 13.2 g of benzotriazole were dissolved in 300 ml of water. The solution was then stirred with the temperature kept at 40° C. A solution of 17 g of silver nitrate in 100 ml of water was added to the solution in 2 minutes.

The pH of the benzotriazole silver emulsion was properly adjusted so that excess salts were sedimented. The excess salts thus sedimented were then removed. The pH of the solution was then adjusted to 6.30 to obtain 400 g of the desired benzotriazole silver emulsion.

The process for the preparation of an acetylene silver emulsion is described hereinafter.

20 g of gelatin and 4.6 g of 4-acetylaminophenyl acetylene were dissolved in 1,000 ml of water and 200 ml of ethanol. The solution thus prepared was then stirred with the temperature thereof kept at 40° C. A solution of 4.5 g of silver nitrate in 200 ml of water was added to the solution in 5 minutes. The pH of the dispersion thus prepared was properly adjusted so that excess salts were sedimented. The excess salts thus sedimented were then removed. The pH of the dispersion was adjusted to 6.3 to obtain 300 g of the desired dispersion of acetylene silver compound.

The process for the preparation of a gelatin dispersion of a dye providing substance is described hereinafter.

5 g of a yellow dye providing substance (A), 0.2 g of an auxiliary developing agent (a), 0.2 g of a fog inhibitor (b), 0.5 g of sodium succinate-2-ethylhexyl ester sulfonate, and 2.5 g of triisononyl phosphate were mixed with 30 ml of ethyl acetate. THe admixture was heated to a temperature of about 60° C. so that dissolution was made to prepare a uniform solution. The solution and 100 g of a 3% solution of gelatin were mixed with stirring. The solution was then subjected to dispersion by means of a homogenizer at 10,000 rpm. The dispersion is referred to as a dispersion of a yellow dye providing substance.

Auxiliary Developing Agent (a)

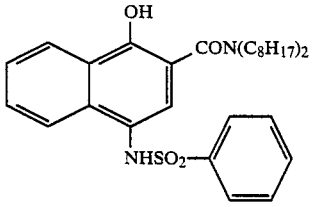

Fog Inhibitor (b)

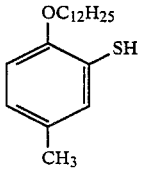

A dispersion of a magenta dye providing substance was prepared in the same manner as above except that a magenta dye providing substance (B) was used and 2.5 g of tricresyl phosphate was used as a high boiling solvent.

A dispersion of a cyan dye providing substance was prepared in the same manner as in the above yellow dye dispersion except that a cyan dye providing substance (C) was used.

These materials were used to prepare a multilayer heat-developable light-sensitive material 100 as shown in the Table below.

Similarly, a heat-developable light-sensitive material 101 having the same structure was prepared in the same manner as in the heat-developable light-sensitive material 100 except the 0.02 g/m$^2$ of the present compound (11) was coated on the 5th layer in the light-sensitive material 100.

Heat-Developable Light-Sensitive Material 100

6th Layer:
Gelatin (coated amount: 800 mg/m$^2$)
Film hardener*3 (coated amount: 16 mg/m$^2$)
Silica*5 (coated amount: 100 mg/m$^2$)
Zinc hydroxide (coated amount: 300 mg/m$^2$)
5th Layer: Green-Sensitive Emulsion Layer
Silver bromochloride emulsion (bromine: 50 mol %, coated amount: 400 mg silver/m$^2$)
Benzotriazole silver emulsion (coated amount: 20 mg silver/m$^2$)
Sensitizing Dye D-1 (coated amount $10^{-6}$ mol/m$^2$)
Film hardener*3 (coated amount: 16 mg/m$^2$)
Yellow Dye Providing Substance (A) (coated amount: 400 mg/m$^2$)
Gelatin (coated amount: 1,400 mg/m$^2$)
High boiling solvent*4 (coated amount: 200 mg/m$^2$)
Surface active agent*2 (coated amount: 100 mg/m$^2$)
4th Layer: Intermediate layer
Gelatin (coated amount: 900 mg/m$^2$)
Film hardener*3 (coated amount: 18 mg/m$^2$)
Zinc hydroxide (coated amount: 300 mg/m$^2$) 3rd Layer: Red-Sensitive Emulsion Layer
Silver bromochloride emulsion (bromine: 80 mol %, coated amount: 300 mg silver/m$^2$)
Acetylene silver emulsion (coated amount: 60 mg silver/m$^2$)
Benzotriazole silver emulsion (coated amount: 20 mg silver/m$^2$)
Sensitizing Dye D-2 ($8\times10^{-7}$ mol/m$^2$)
Film hardener*3 (coated amount: 18 mg/m$^2$)
Magenta Dye Providing Substance (B) (coated amount: 400 mg/m$^2$)
Gelatin (coated amount: 800 mg/m$^2$)
High boiling solvent*1 (coated amount: 200 mg/m$^2$)
Surface active agent*2 (coated amount: 100 mg/m$^2$)
2nd Layer: Intermediate Layer
Gelatin (coated amount: 800 mg/m$^2$)
Film hardener*3 (coated amount: 16 mg/m$^2$)
Zinc hydroxide (coated amount: 300 mg/m$^2$) 1st Layer: Infrared-Sensitive Emulsion Layer
Silver bromochloride emulsion (bromine: 50 mol %, coated amount: 300 mg silver/m$^2$)
Acetylene silver emulsion (coated amount: 25 mg silver/m$^2$)
Benzotriazole silver emulsion (coated amount: 50 mg silver/m$^2$)
Sensitizing Dye D-3 (coated amount: $10^{-8}$ mol/m$^2$)
Film hardener*3 (coated amount: 16 mg/m$^2$)
Cyan Dye Providing Substance (C) (coated amount: 300 mg/m$^2$)
Gelatin (coated amount: 600 mg/m$^2$)
High boiling solvent*4 (coated amount: 150 mg/m$^2$)
Surface active agent*2 (coated amount: 100 mg/m$^2$)

| Support | |
|---|---|
| *1: | Polyethylene terephthalate (180 μm thick) |
| *2: | 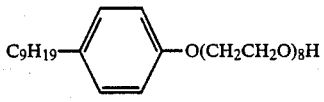 |
-continued
| Support | |
|---|---|
| *3: | 1,2-Bis(vinylsulfonylacetamido)ethane |
| *4: | $(Iso\text{-}C_9H_{19}O)_3P{=}O$ |
| *5: | 4 μm size |
Dye Providing Substance
(A)
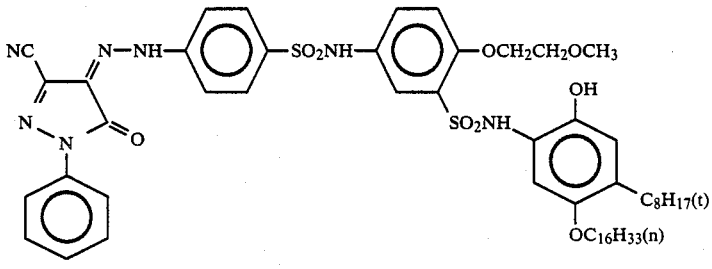
(B)
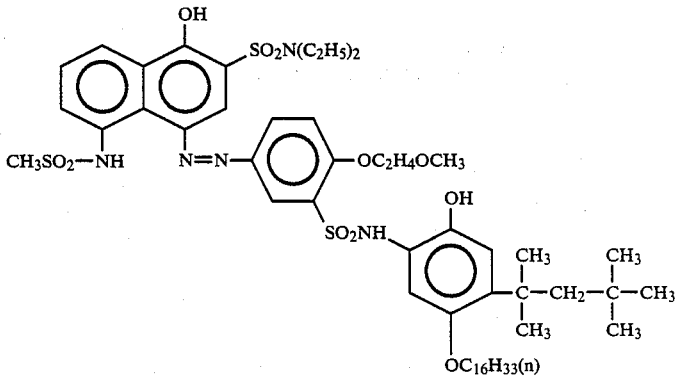
(C)
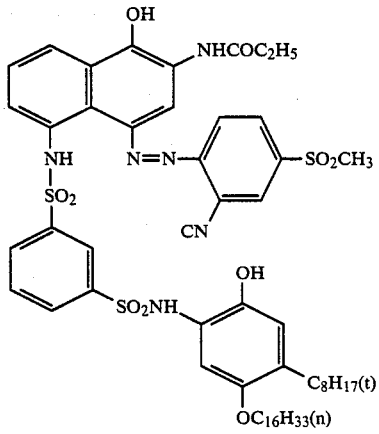
(D-1)
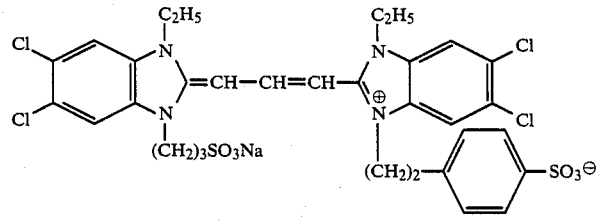

-continued (D-2)

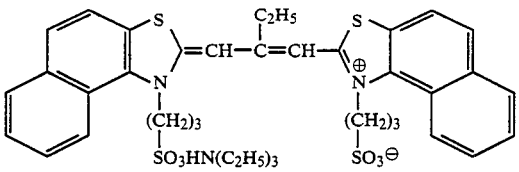

(D-3)

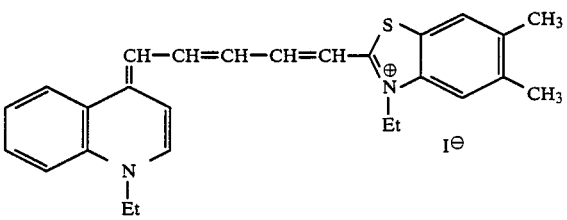

The process for the preparation of a dye fixing material R-1 is described hereinafter.

10 g of poly(methyl acrylate -co-N,N,N-trimethyle-N-vinylbenzylammonium chloride) (ratio of methyl acrylate to vinylbenzylammonium chloride: 1/1) was dissolved in 175 ml of water. The solution was uniformly mixed with 100 g of 10% lime-processed gelatin. 25 ml of a 4% aqueous solution of 2,4-dichloro-6-hydroxy-1,3,5-triazine was added to the admixture. The admixture was then uniformly coated on a paper support laminated with polyethylene comprising titanium dioxide dispersed therein to a wet film thickness of 90 μm.

4.8 ml of a 1% aqueous solution of 3.6 g of guanidine picolate, 18 ml of water, 20 g of 10% gelatin, and sodium succinate-2-ethylhexyl ester sulfonate was coated on the coated film to a wet film thickness of 30 μm. The coated film was then dried to obtain a dye fixing material R-1 having a mordant layer.

The above-described multilayer heat-developable light-sensitive materials 100 and 101 were subjected to the following tests.

Test 1

These light-sensitive materials were exposed to light of 500 lux from a tungsten lamp through a G, R and IR separation filters (G: 500–600 nm bandpass filter, R: 600–700 nm bandpass filter, IR: filter passing 700 nm or higher) for 1 second.

The emulsion surface of the heat-developable light-sensitive materials thus exposed were supplied with 20 ml/m$^2$ of water through a wire bar. The light-sensitive materials were then superimposed on the dye fixing material R-1 in such a manner that the film surfaces thereof were brought into contact with each other.

The laminations were then heated for 30 seconds by means of a heat roller whose temperature had been adjusted to keep the temperature of the films thus wet at 88° to 98° C. The dye fixing material was then peeled off the light-sensitive materials to obtain on the dye fixing material sharp yellow, magenta and cyan images corresponding to the G, R and IR separation filters. The density of the yellow and magenta dye images were measured by a Macbeth reflection densitometer (RD-519). The results are shown in Table 1.

Test 2

The above-described multilayer heat-developable light-sensitive materials 100 and 101 were subjected to ageing at room temperature for 2 days and at a temperature of 60° C. and a relative humidity of 60% for 2 days. These test specimens were then subjected to the same treatment as in Test 1 except that a heat roller which had been adjusted to keep the temperature of the wet films at 93° C. was used. The results are shown in Table 1.

TABLE 1

| Heat-Developable Light-Sensitive Material | | Test 1 | | | | Test 2 (processed at 93° C.) | | | |
|---|---|---|---|---|---|---|---|---|---|
| | | Fog Density | | Maximum Density | | Aged at Room Temperature for 2 Days | Aged at 60° C., 70% for 2 Days | Aged at Room Temperature for 2 Days | Aged at 60° C., 70% for 2 Days |
| | | Processed at 88° C. | Processed at 98° C. | Processed at 88° C. | Processed at 98° C. | | | | |
| 100 (Comparison) | Yellow | 0.09 | 0.20 | 2.00 | 2.10 | 0.10 | 0.30 | 2.00 | 2.00 |
| | Magenta | 0.12 | 0.30 | 2.20 | 2.30 | 0.14 | 0.20 | 2.20 | 2.25 |
| 100 (Invention) | Yellow | 0.08 | 0.12 | 2.00 | 2.10 | 0.09 | 0.11 | 2.00 | 2.00 |
| | Magenta | 0.10 | 0.13 | 2.20 | 2.30 | 0.12 | 0.14 | 2.25 | 2.25 |

Table 1 shows that the heat-developable light-sensitive material comprising the present acetylene compound can maintain the desired maximum density not only at the yellow dye layer in which the acetylene compound is incorporated but also at the adjacent magenta dye layer and exhibits low fog densities after processed at elevated temperatures or aged.

EXAMPLE 2

Heat-developable light-sensitive materials 102, 103, 104, 105, 106 and 107 were prepared in the same manner as in the heat-developable light-sensitive materials of Example 1 except that the exemplary compounds (2), (5), (9), (13), (16) and (17) were used as the present acetylene compounds, respectively. These light-sensitive materials were then processed in the same manner as in Example 1. The results are shown in Table 2.

TABLE 2

| Heat-Developable Light-Sensitive Material | | Test 1 | | | | Test 2 (processed at 93° C.) | | | | Acetylene Compound |
|---|---|---|---|---|---|---|---|---|---|---|
| | | Fog Density | | Maximum Density | | Fog Density | | Maximum Density | | |
| | | Processed at 88° C. | Processed at 98° C. | Processed at 88° C. | Processed at 98° C. | Aged at Room Temp. for 2 Days | Aged at 60° C., 70% for 2 Days | Aged at Room Temp. for 2 Days | Aged at 60° C., 70% for 2 Days | |
| 102 (Invention) | Yellow | 0.08 | 0.13 | 2.00 | 2.05 | 0.09 | 0.11 | 2.05 | 2.05 | (2) |
| | Magenta | 0.10 | 0.13 | 2.25 | 2.30 | 0.11 | 0.12 | 2.25 | 2.27 | |
| 103 (Invention) | Yellow | 0.08 | 0.12 | 2.00 | 2.10 | 0.10 | 0.12 | 2.05 | 2.10 | (5) |
| | Magneta | 0.11 | 0.13 | 2.20 | 2.30 | 0.12 | 0.13 | 2.30 | 2.30 | |
| 104 (Invention) | Yellow | 0.07 | 0.11 | 2.05 | 2.10 | 0.09 | 0.11 | 2.05 | 2.07 | (9) |
| | Magneta | 0.09 | 0.12 | 2.15 | 2.25 | 0.10 | 0.11 | 2.15 | 2.20 | |
| 105 (Invention) | Yellow | 0.08 | 0.12 | 2.05 | 2.10 | 0.09 | 0.11 | 2.07 | 2.07 | (13) |
| | Magenta | 0.10 | 0.12 | 2.15 | 2.20 | 0.11 | 0.12 | 2.20 | 2.20 | |
| 106 (Invention) | Yellow | 0.07 | 0.11 | 2.00 | 2.05 | 0.09 | 0.12 | 2.03 | 2.05 | (16) |
| | Magenta | 0.10 | 0.12 | 2.20 | 2.25 | 0.11 | 0.12 | 2.25 | 2.25 | |
| 107 (Invention) | Yellow | 0.08 | 0.13 | 2.05 | 2.15 | 0.09 | 0.12 | 2.10 | 2.10 | (17) |
| | Magenta | 0.10 | 0.14 | 2.20 | 2.30 | 0.12 | 0.13 | 2.25 | 2.30 | |

Table 2 shows that the heat-developable light-sensitive materials comprising the present acetylene compounds can maintain the desired maximum density not only at the yellow dye layer in which the acetylene compounds are incorporated but also at the adjacent magenta dye layer and exhibit low fog densities after processed at elevated temperatures or aged.

EXAMPLE 3

A heat-developable light-sensitive material 108 having the same structure as the heat-developable light-sensitive material 100 was prepared in the same manner as in the heat-developable light-sensitive material 100 except that the 1st, 3rd, and 5th layers were each provided with 0.02 g/m$^2$ of the present compound (11).

The light-sensitive material 108 was then processed in the same manner as in Example 1. The results show that the light-sensitive material 108, which comprises the present acetylene compound, can maintain the desired maximum density and exhibits low fog densities after processed at elevated temperatures or aged.

EXAMPLE 4

A heat-developable light-sensitive material 200 having a multilayer structur shown below was prepared using the same emulsions and gelatin dispersions of the dye providing substances as used in Example 1.

Similarly, a heat-developable light-sensitive material 201 having the same structure as the heatdevelopable light-sensitive material 200 was prepared in the same manner as in the heat-developable lightsensitive material 200 except that the 5th layer was provided with 0.02 g/m$^2$ of the present compound (11).

Heat-Developable Light-Sensitive Material 200

6th Layer:
Gelatin (coated amount: 1,000 mg/m$^2$)
Base precursor*3 (coated amount: 600 mg/m$^2$)
Film hardener*6 (coated amount: 100 mg/m$^2$)
Silica*5 (coated amount: 100 mg/m$^2$)
5th Layer: Green-Sensitive Emulsion Layer
Silver bromochloride emulsion (bromine content: 50 mol %, coated amount: 400 mg silver/m$^2$)
Benzenesulfonamide (coated amount: 180 mg/m$^2$)
Benzotriazole silver emulsion (coated amount: 100 mg/m$^2$)
Sensitizing Dye D-1 (coated amount: $10^{-6}$ mol/m$^2$)
Base precursor*3 (coated amount: 500 mg/m$^2$)
Yellow Dye Providing Substance (B) (coated amount: 400 mg/m$^2$)
Gelatin (coated amount: 1,000 mg/m$^2$)
High boiling solvent *4 (coated amount: 800 mg/m$^2$)
Surface active agent*2 (coated amount: 100 mg/m$^2$)
4th Layer: Intermediate Layer
Gelatin (coated amount: 1,200 mg/m$^2$)
Base precursor*3 (coated amount: 600 mg/m$^2$) 3rd Layer: Red-Sensitive Emulsion Layer
Silver bromochloride emulsion (bromine content: 80 mol %, coated amount: 300 mg silver/m$^2$)
Benzenesulfonamide (coated amount: 180 mg/m$^2$)
Benzotriazole silver emulsion (coated amount: 100 mg silver/m$^2$)
Sensitizing Dye D-2 ($8\times10^{-7}$ mol/m$^2$)
Base precursor*3 (coated amount: 450 mg/m$^2$)
Magenta Dye Providing Substance (A) (coated amount: 400 mg/m$^2$)
Gelatin (coated amount: 1,000 mg/m$^2$)
High boiling solvent*1 (coated amount: 600 mg/m$^2$)
Surface active agent*2 (coated amount: 100 mg/m$^2$)
2nd Layer: Intermediate Layer
Gelatin (coated amount: 1,000 mg/m$^2$)
Base precursor*3 (coated amount: 600 mg/m$^2$) 1st Layer: Infrared-Sensitive Emulsion Layer
Silver bromochloride emulsion (bromine content: 50 mol %, coated amount: 300 mg silver/m$^2$)
Benzenesulfonamide (coated amount: 180 mg/m$^2$)
Benzotriazole silver emulsion (coated amount: 100 mg silver/m$^2$)
Sensitizing Dye D-3 (coated amount: $10^{-8}$ mol/m$^2$)
Base precursor*3 (coated amount: 500 mg/m$^2$)
Cyan Dye Providing Substance (C) (coated amount: 300 mg/m$^2$)
Gelatin (coated amount: 1,000 mg/m$^2$)
High boiling solvent*4 (coated amount: 600 mg/m$^2$)
Surface active agent*2 (coated amount: 100 mg/m$^2$)

| Support | |
|---|---|
| *1: | Tricresyl phosphate |
| *2: | 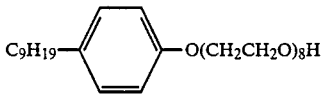 |
| *3: | Guanidine 4-acetylaminophenylpropiolate |
| *4: | (Iso-$C_9H_{19}O)_3P{=}O$ |
| *5: | 4 μm size |
| *6: | 1,2-Bis(vinylsulfonylacetamido)ethane |

The process for the preparation of the dye fixing material R-2 is described hereinafter.

10 g of poly(methyl acrylate-co-N,N,N-trimethyl-N-vinylbenzylammonium chloride) (molar ratio of methyl acrylate to vinylbenzylammonium chloride: 1/1) was dissolved in 200 ml of water. The solution was then uniformly mixed with 100 g of 10% lime-processed gelatin. The mixed solution was uniformly coated on a paper support laminated with polyethylene having titanium dioxide dispersed therein to a wet film thickness of 90 μm. The specimen thus obtained was dried to provide the desired dye fixing material R-2 comprising a mordant layer.

The above-described multilayer heat-developable light-sensitive materials 200 and 201 were then subjected to the following test:

Test 3

These heat-developable light-sesitive materials 200 and 201 were exposed to light of 500 lux from a tungsten lamp through G, R and IR separation filters (G: 500–600 nm bandpass filter, R: 600–700 nm bandpass filter, IR: filter passing 700 nm or higher) having a grade density for 1 second.

These light-sensitive materials were then heated over a heat block which had been heated to a temperature of 150° C. for 20 seconds or 30 seconds.

The film surface of the dye fixing material R-2 was supplied with 20 ml/m$^2$ of water. The light-sensitive materials thus heated were superimposed on the dye fixing material thus wet in such a manner that the film surfaces thereof were brought into contact with each other. The laminations were then heated over a heat block which had been heated to a temperature of 80° C. for 6 seconds. The dye fixing material was then peeled off the light-sensitive materials to obtain on the fixing material yellow, magenta and cyan dye images corresponding to the G, R and IR separation filters. The maximum density ($D_{max}$) and the minimum density ($D_{min}$) of the yellow and magenta dye images were measured by means of a Macbeth reflection densitometer (RD-519).

The results obtained are shown in Table 3.

TABLE 3

| Heat-Developable Light-Sensitive Material | | Fog Density | | Maximum Density | |
|---|---|---|---|---|---|
| | | Processed for 20 sec. | Processed for 30 sec. | Processed for 20 sec. | Processed for 30 sec. |
| 200 (Comparison) | Yellow | 0.20 | 0.38 | 2.00 | 2.05 |
| | Magenta | 0.21 | 0.32 | 2.05 | 2.20 |
| 201 (Invention) | Yellow | 0.18 | 0.21 | 2.05 | 2.10 |
| | Magenta | 0.20 | 0.24 | 2.15 | 2.25 |

Table 3 shows that the heat-developable light-sensitive material comprising the present acetylene compound can maintain the desired maximum density not only at the yellow dye layer in which the acetylene compound is incorporated but also at the adjacent magenta layer and exhibits low fog densities after processed at an elevated temperature for a prolonged period of time.

EXAMPLE 5

The process for the preparation of a silver halide emulsion for the 1st layer is described hereinafter.

Emulsion (I)

600 ml of an aqueous solution containing 56 g of potassium bromide and 7 g of sodium chloride and an aqueous solution of silver nitrate which had been obtained by dissolving 0.59 mol of silver nitrate in 600 ml of water were simultaneously added to an aqueous solution of gelatin which had been prepared by dissolving 20 g of gelatin and 2 g of sodium chloride in 1,000 ml of water and kept at a temperature of 75° C. at the same flow rate in 60 minutes while the latter was being vigorously stirred. After being washed with water and desalted, the emulsion was adjusted to a pH of 6.5 and a pAg of 7.9 with 40 g of gelatin and 200 ml of water. The emulsion was then subjected to an optimum chemical sensitization with sodium thiosulfate and 4-hydroxy-6-methyl-1,3,3a,7-tetraazaindene to obtain 700 g of a monodispersed emulsion of hexahedral particles having an average particle size of 0.4 μm.

The process for the preparation of a silver halide emulsion for the 3rd layer is described hereinafter.

Emulsion (II)

Emulsions (A) and (B) were prepared in the undermentioned manners. Emulsions (A) and (B) thus prepared were then mixed in half the amounts obtained to provide Emulsion (II).

20 g of gelatin, 1.2 g of potassium bromide and 6 cc of 25% ammonium water were put into 600 ml of water in a beaker with stirring. A solution of 100 g of silver nitrate in 600 ml of water and a solution of 116 g of potassium bromide and 4 g of potassium iodide in 1,000 ml of water were added to the solution thus obtained while the latter was being kept at a temperature of 50° C. and a pAg of 8.9 in a controlled double jet process in 50 minutes. At the same time with the addition of the silver halide solution and the silver nitrate solution, a solution of 0.15 g of the undermentioned dye (D) in 75 ml of methanol was added to the system in 25 minutes.

Dye (D)

-continued

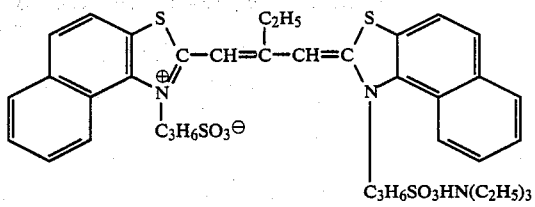

After being washed with water and desalted, the emulsion was adjusted to a pH of 6.3 with 20 g of gelatin and 100 m of water and to a pAg of 9.3 with potassium bromide. The emulsion was then subjected to an optimum chemical sensitization with sodium thiosulfate to obtain 700 g of a panchromatically sensitized emulsion of particulate silver bromoiodide (A) having a particle size of 0.5 μm and a pebble-like shape.

Emulsion (B) was prepared in the same manner as in Emulsion (A) except that 25% ammonium water was used in an amount of 2.5 cc rather than 6 cc. Emulsion (B) contained particles having a size of 0.3 μm.

The process for the preparation of an emulsion for the 5th layer is described hereinafter.

Emulsion (III) was prepared by preparing Emulsions (A) and (B) in the undermentioned manners and then mixing the two emulsions in half the amounts obtained.

Emulsion (A)

600 ml of an aqueous solution containing potassium bromide and sodium chloride in a total amount of 0.59 mol and 600 ml of an aqueous solution containing 0.59 mol of silver nitrate were simultaneously added to an aqueous solution of gelatin which had been prepared by dissolving 20 g of gelatin and 2 g of sodium chloride in 1,000 ml of water and kept at a temperature of 60° C. at the same flow rate in 25 minutes while the latter was being vigorously stirred to prepare a monodispersed emulsion of cubic particulate silver bromochloride having 80 mol % of Br and a size of 0.25 μm. At the same time with the formation of the particulate silver halide, a solution of 0.16 g of the undermentioned dye (E) in 400 cc of methanol was added to the aqueous solution of gelatin in 15 minutes.

After being washed with water and desalted, the emulsion was adjusted with 40 g of gelatin and 200 ml of water to a pH of 6.4 and a pAg of 7.8. The emulsion was then subjected to an optimum chemical sensitization with sodium thiosulfate, chloroauric acid, and 4-hydroxy-6-methyl-1,3,3a,7-tetraazaindene.

The yield of the desired emulsion was 700 g.

Dye (E)

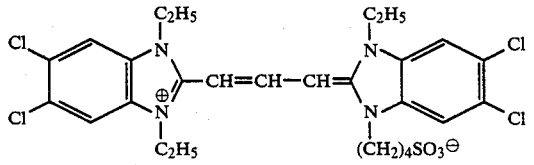

Emulsion (B)

600 ml of an aqueous solution containing potassium bromide and sodium chloride in a total amount of 0.59 mol and 600 ml of an aqueous solution containing 0.59 mol of silver nitrate were added to an aqueous solution of gelatin which had been prepared by dissolving 20 g of gelatin, 2 g of sodium chloride, and 0.015 g of the undermentioned compound in 1,000 ml of water and kept at a temperature of 75° C. in 60 minutes while the latter was being vigorously stirred to prepare an emulsion of cubic particulate silver bromochloride having 80 mol % of Br and a size of 0.5 μm.

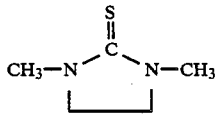

At the same time with the formation of the particulate silver halide, a solution of 0.16 g of the dye (E) as used in Emulsion (A) in 400 cc of methanol was added to the aqueous solution of gelatin in 30 minutes. After being washed with water and desalted, the emulsion was adjusted with 40 g of gelatin and 200 ml of water to a pH of 6.4 and a pAg of 8.0. The emulsion was then subjected to an optimum chemical sensitization with triethyl thiourea and a decomposition product of a nucleic acid. The yield of the desired emulsion was 700 g.

The process for the preparation of a dispersion (IV) is described hereinafter.

5 g of the undermentioned compound, 20 ml of ethyl acetate, and 5 g of a high boiling solvent*3 were mixed and heated to a temperature of about 60° C. to obtain a solution.

Compound (F)

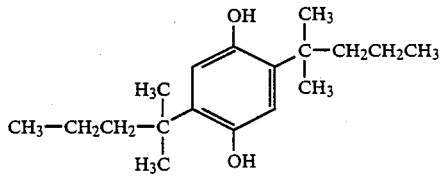

The process for the preparation of a gelatin dispersion of a dye providing substance is described hereinafter.

5 g of a yellow dye providing substance (G), 0.5 g of sodium suucinate-2-ethylhexyl ester sulfonate as a surface active agent, and 2.5 g of triisononyl phosphate were mixed with 30 ml of ethyl acetate, and heated to a temperature of about 60° C. to obtain a uniform solution. The solution thus obtained and 100 g of 3% solution of lime-processed gelatin were mixed with stirring. The solution was then subjected to dispersion at 10,000 rpm for 10 minutes by means of a homogenizer. The dispersion is referred to as a dispersion of a yellow dye providing substance A dispersion of a magenta dye providing substance was prepared in the same manner as above except that a magenta dye providing substance (H) was used and tricresyl phosphate was used as a high boiling solvent in an amount of 2.5 g.

A dispersion of a cyan dye providing was prepared in the same manner as in the yellow dye dispersion except that a cyan dye providing (I) was used.

With these materials, a heat-developable light-sensitive material 300 having a multilayer structure as shown below was prepared.

Heat-Developable Light-Sensitive Material 300

7th Layer: Protective Layer

Gelatin (350 mg/m$^2$)

Silica*6 (100 mg/m$^2$)
6th Layer: Protective Layer
Dispersion IV (50 mg/m$^2$)
High boiling solvent*3 (50 mg/m$^2$)
Gelatin (500 mg/m$^2$)
Zinc hydroxide (300 mg/m$^2$)
Film hardener*2 (10 mg/m$^2$)
5th Layer: Green-Sensitive Layer
Emulsion III (400 mg silver/m$^2$)
Benzotriazole silver emulsion (50 mg silver/m$^2$)
Acetylene silver emulsion (50 mg silver/m$^2$)
Film hardener*2 (16 mg/m$^2$)
Yellow Dye Providing Substance G (440 mg/m$^2$)
Gelatin (1,000 mg/m$^2$)
High boiling solvent*3 (200 mg/m$^2$)
Surface active agent*4 (100 mg/m$^2$)
2,6-Dichloro-p-aminophenol (78 mg/m$^2$)
4th Layer: Intermediate Layer
Gelatin (700 mg/m$^2$)
Film hardener*2 (18 mg/m$^2$)
Zinc hydroxide (coated amount: 300 mg/m$^2$)
Dispersion IV (50 mg/m$^2$)
3rd Layer: Red-Sensitive Layer
Emulsion II (300 mg/m$^2$ silver)
Benzotriazole silver emulsion (50 mg silver/m$^2$)
Acetylene silver emulsion (50 mg silver/m$^2$)
Film hardener*2 (18 mg/m$^2$)
Magenta Dye Providing Substance H (400 mg/m$^2$)
Gelatin (coated amount: 1,000 mg/m$^2$)
High boiling solvent*5 (200 mg/m$^2$)
Surface active agent*4 (100 mg/m$^2$)
2,6-Dichloro-p-aminophenol (58 mg/m$^2$)
2nd Layer: Intermediate Layer
Gelatin (800 mg/m$^2$)
Film hardener*2 (16 mg/m$^2$)
Zinc hydroxide (300 mg/m$^2$)
Dispersion IV (50 mg/m$^2$)
1st Layer: Infrared-Sensitive Layer
Emulsion I (300 mg silver/m$^2$)
Benzotriazole silver emulsion (50 mg silver/m$^2$)
Acetylene silver emulsion (50 mg silver/m$^2$)
Sensitizing dye*1 ($10^{-7}$ mol/m$^2$)
Film hardener*2 (16 mg/m$^2$)
Cyan Dye Providing Substance I (300 mg/m$^2$)
Gelatin (1,000 mg/m$^2$)
High boiling solvent*3 (150 mg/m$^2$)
Surface active agent*4 (1,000 mg/m$^2$)
2,6-Dichloro-p-aminophenol (46 mg/m$^2$)

---

Support
Sentizing Dye*1

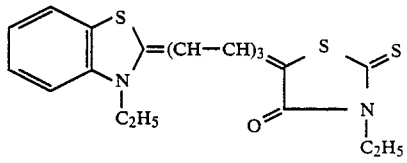

Film Hardener*2
1,2-Bis(vinylsulfonylacetamido)ethane
High Boiling Solvent*3
$(Iso\text{-}C_9H_{13}O)_3P{=}O$
Surface Active Agents*4

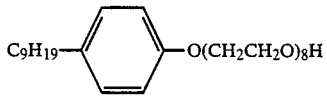

High Boiling Solvent*5
Tricresyl phosphate
Silica*6
4 μm size

---

Yellow Dye Providing Substance (G)

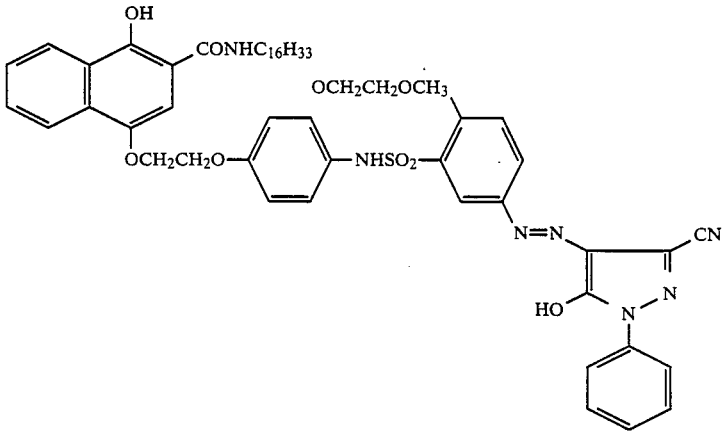

Magenta Dye Provinding Substance (H)

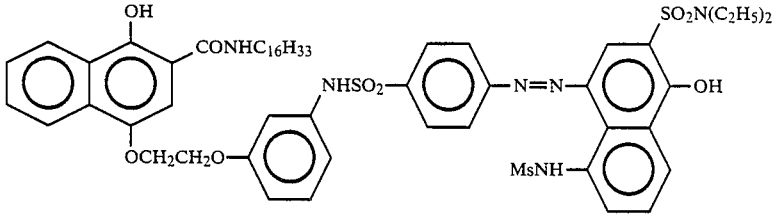

-continued

Cyan Dye Providing Substance (I)

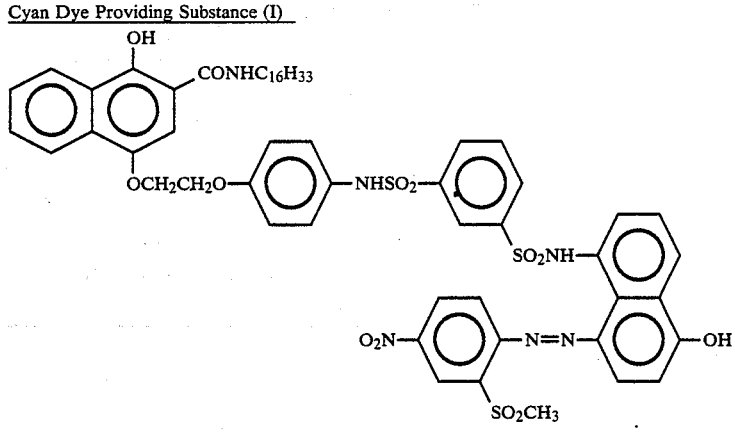

Similarly, a heat-developable light-sensitive material having the same structure as the heat-developable light-sensitive material 300 was prepared in the same manner as in the heat-developable light-sensitive material 300 except that the 5th layer was provided with the present compound (11) in an amount of 0.2 g/m$^2$.

The light sensitive material 300 was then subjected to Test 1 using the same dye fixing material R-1 as used in Example 1 in the same manner as in Example 1. The results are shown in Table 4.

TABLE 4

| Heat-Developable Light-Sensitive Material | | Test 1 | | | |
|---|---|---|---|---|---|
| | | Fog Density | | Maximum Density | |
| | | Processed at 88° C. | Processed at 98° C. | Processed at 88° C. | Processed at 98° C. |
| 300 (Comparison) | Yellow | 0.12 | 0.35 | 1.95 | 2.00 |
| | Magenta | 0.14 | 0.42 | 2.12 | 2.15 |
| 301 (Invention) | Yellow | 0.10 | 0.16 | 2.00 | 2.05 |
| | Magneta | 0.13 | 0.17 | 2.15 | 2.20 |

Table 4 shows that the heat-developable light-sensitive material comprising the present acetylene compound can maintain the desired maximum density not only at the yellow dye layer in which the acetylene compound is incorporated but also at the adjacent magenta dye layer and exhibits low fog densities after being processed at elevated temperatures.

While the invention has been described in detail and with reference to specific embodiments thereof, it will be apparent to one skilled in the art that various changes and modifications can be made therein without departing from the spirit and scope thereof.

What is claimed is:

1. A heat-developable light-sensitive material comprising at least one light-sensitive silver halide emulsion layer provided on a support, wherein said material further contains an acetylene compound represented by the general formula (II):

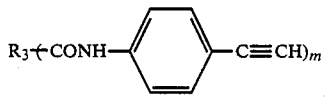

(II)

wherein m is 1 or 2; when m is 1, then $R_3$ is an alkyl group containing 3 or more carbon atoms or a cycloalkyl group containing 3 or more carbon atoms, each of which may be substituted; and when m is 2, then $R_3$ is an alkylene group, an arylene group, or a cycloalkylene group, each of which may be substituted.

2. The heat-developable light-sensitive material of Claim 1, wherein m is 1; and $R_3$ is an alkyl group containing 3 to 20 carbon atoms, which may be substituted, or a cycloalkyl group containing 3 to 20 carbon atoms, which may be substituted.

3. The heat-developable light-sensitive material of claim 1, wherein the alkyl group represented by $R_3$ contains 3 to 10 carbon atoms.

4. The heat-developable light-sensitive material of claim 1, wherein the cycloalkyl group represented by $R_3$ contains 3 to 10 carbon atoms.

5. The heat-developable light-sensitive material of claim 1, wherein the amount of the acetylene compound to be incorporated is $10^{-4}$ to 1 mol per mol of silver.

6. The heat-developable light-sensitive material of claim 5, wherein the amount of the acetylene compound to be incorporated is $10^{-3}$ to $5\times10^{-1}$ mol per mol of silver.

7. The heat-developable light-sensitive material of claim 1, wherein said material further contains a dye-providing substance.

* * * * *